US005601152A

United States Patent [19]

Harrison

[11] Patent Number: 5,601,152

[45] Date of Patent: Feb. 11, 1997

[54] VIBRATOR CORE DRILLING APPARATUS

[75] Inventor: Simon J. Harrison, Callander, Canada

[73] Assignee: Boart Longyear Inc., North Bay, Canada

[21] Appl. No.: 409,194

[22] Filed: Mar. 23, 1995

[51] Int. Cl.[6] ..... E21B 25/00

[52] U.S. Cl. ..... 175/246; 175/248

[58] Field of Search ..... 175/246, 247, 175/248, 405

[56] References Cited

U.S. PATENT DOCUMENTS 3,049,185 8/1962 Herbold .
3,194,326 7/1965 Bodine .
3,333,647 11/1964 Karich .
4,279,315 7/1981 Tibussek .
4,558,749 12/1985 Fulkerson ..... 175/248 X

*Primary Examiner*—William P. Neuder
*Attorney, Agent, or Firm*—Clayton R. Johnson

[57] ABSTRACT

A drilling tool, for example a core barrel inner tube assembly, includes a latch body mounting latches for movement into a latch seat to removably retain the assembly adjacent to a drill string bit end and to impart rotary movement to the latch body as the drill string is rotated. A spindle subassembly is connected to the axial inner end of the latch body, to in turn, mount a vibrational subassembly for imparting axial reciprocal movement to a core receiving tube as the drill string is rotated to facilitate entry of core into the tube. The vibrational assembly converts rotary motion of the spindle subassembly to axial reciprocal movement of the core receiving tube while the core receiving tube is not being rotated but is moved axially inwardly over the core.

18 Claims, 3 Drawing Sheets

VIBRATOR CORE DRILLING APPARATUS

BACKGROUND OF THE INVENTION

The present invention relates to drilling apparatus and more particularly to mechanism for vibrating the core receiving tube as the drill string is being rotated.

At times, during core drilling operation, greater resistance to the core receiving tube slipping axially inwardly along the core as the cut is being cut is encountered than is desirable. Also, at times, during core drilling operation and more particularly when drilling in broken earth formations and sandy and/or gravel type formations, the core will become more packed along the inner peripheral wall of the core receiving tube than at the radial central part of the tube and/or the radial outer part of the tube will fill up while the central part of the tube is not filled.

U.S. Pat. No. 4,279,315 to Tibussek discloses a wire line core barrel inner tube assembly that includes a latch body mounting latches for movement into a latch seat to retain said assembly adjacent to the drill bit, and clutch dogs movable into grooves in the drill string to rotate the latch body with the drill string. The latch body is rotatable relative to the core receiving tube and as the latch body rotates, a hammer strikes an anvil to impart striking force that is applied to the core receiving tube.

U.S. Pat. No. 3,194,326 to Bodine discloses a coring tool for obtaining a core underwater and subjecting the tube to sonic vibrations for providing a force that, during the half cycle of elastic elongation of the elastic stem, results in the core receiving tube moving downwardly in the earth formation. Herbold, U.S. Pat. No. 3,049,185, discloses a link pivotally connected between spaced magnetic disks and the core receiving tube. The magnetic disks are magnetically attached to the radial inner surface of a drilling tube to be eccentric to the central axis of the drilling tube and are rotated to generate centrifugal forces that are said to decrease frictional resistance to drilling.

In order to make improvements in core drilling apparatus to facilitate the collection of a core sample, this invention has been made.

SUMMARY OF THE INVENTION

A drilling assembly that is movable in a drill string to the inner end portion thereof for being latchingly retained therein for collecting a core sample and which includes a latch body with retractable latches for releasably retaining the core receiving tube adjacent to the core bit and when in a latch seated position, the drill string, in rotating, imparts a rotary motion to the latches and therethrough to the latch body. The latch body in rotating imparts a rotational movement through a spindle subassembly to a vibrational subassembly which converts rotational movement to axial movement. This axial movement is imparted to the core receiving tube to axially reciprocate the core receiving tube while not rotating the core receiving tube, even though the latch body and drill string are rotating, in order to facilitate core moving into the core receiving tube and the filling of the tube with the core.

One of the objects of this invention is to provide new and novel vibrational core feeder means for facilitating the entry of core into a core receiving tube while collecting a core sample in an earth formation. Another object of this invention is to provide new and novel means for imparting axial vibrations to a core receiving tube without rotating the core receiving tube to facilitate the collection of a sample from an earth formation. Still another object of this invention is to provide new and novel means for imparting reciprocal axial movement to a core receiving tube while a latch body of a core barrel inner tube assembly is rotating and the core receiving tube has core entering thereinto.

A different object of this invention is to provide in core drilling apparatus, new and novel means for imparting movement to a core receiving tube to facilitate movement of a core receiving tube over a core to enhance the likelihood of the core receiving tube being completely filled adjacent to the inner peripheral wall of the receiving tube over that adjacent to the radial central part of tube and/or while decreasing the likelihood of increased packing of the core more closely adjacent to the receiving tube inner peripheral wall than the central part of the tube, particularly when drilling in a broken earth formation or a sandy gravel formation. Still another object of this invention is to provide new and novel means operated by the rotation of the drill string to mechanically impart axial reciprocal movement to a core receiving tube as the core receiving tube remains rotationally stationary.

For purposes of facilitating the description of the invention, the term "inner" refers to that portion of the drill string, or of the assembly, or an element of the assembly being described which in its position "for use" in, or on, the drill string is located closer to the drill bit on the drill string (or bottom of the hole being drilled) than any other portion of the apparatus being described, except where the term clearly refers to a transverse circumferential, direction, or diameter of the drill string or other apparatus being described. The term "outer" refers to that portion of the drill string, or of the assembly, or an element of the assembly being described which in its position "for use" in, or on, the drill string is located axially more remote from the drill bit on the drill string (or bottom of the hole being drilled) than any other portion of the apparatus being described, except where the term clearly refers to a transverse circumferential, direction, or diameter of the drill string or other apparatus being described.

DESCRIPTION OF THE PREFERRED EMBODIMENT

Figure 1:
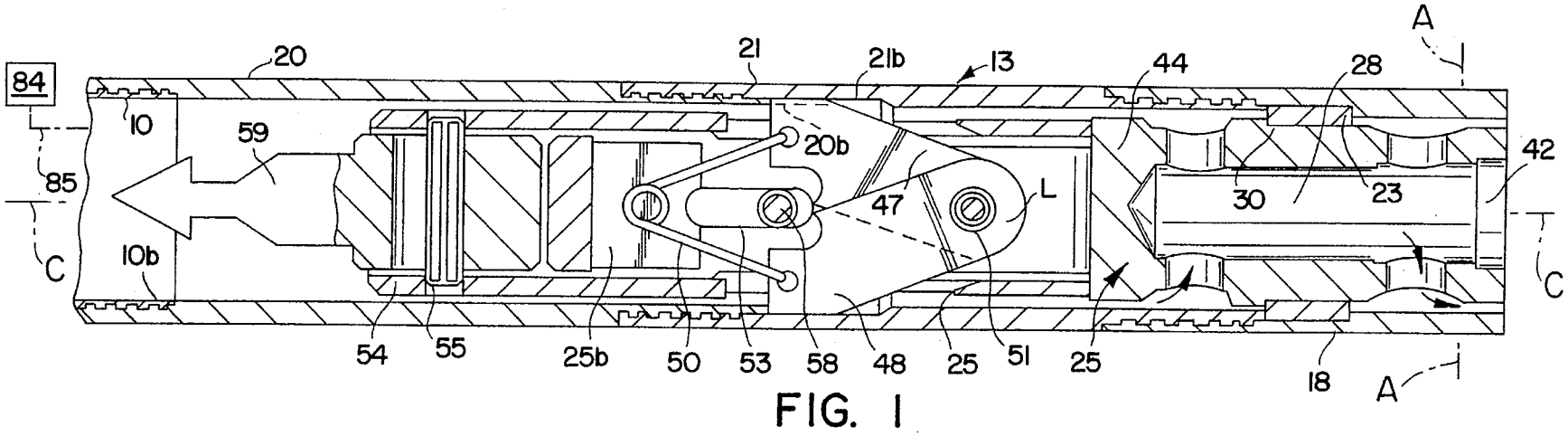
FIGS. 1–3 one arranged above the other with the axial center lines aligned and lines A—A of FIGS. 1 and 2 aligned, and lines B—B of FIGS. 2 and 3 aligned, form a composite longitudinal section through the drilling apparatus of this invention with the latches being in a latch seated locked position and an axial intermediate portion of FIG. 3 broken away.
Figure 2:
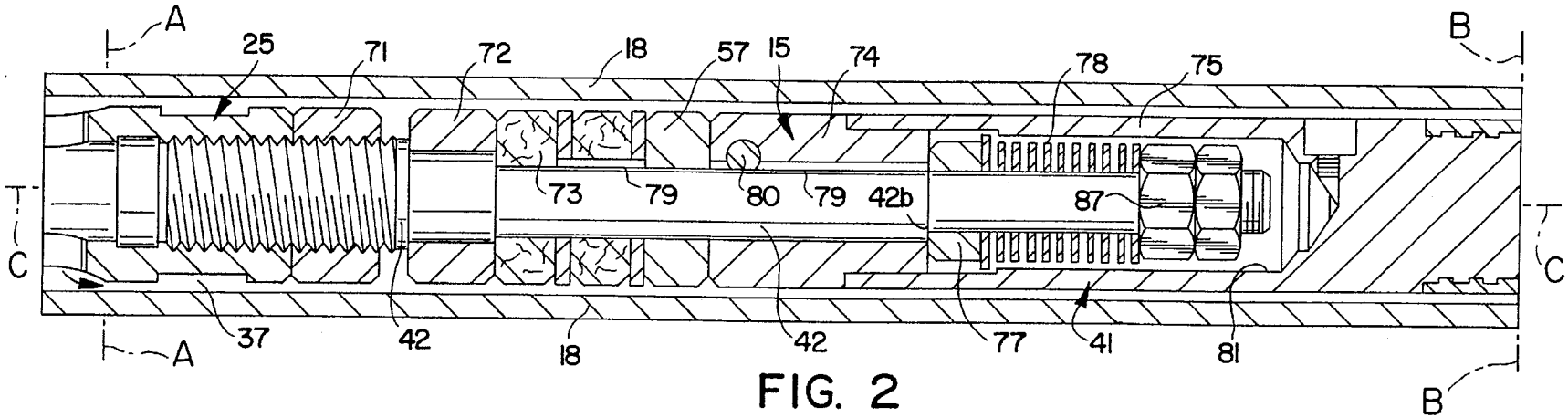
Figure 3:
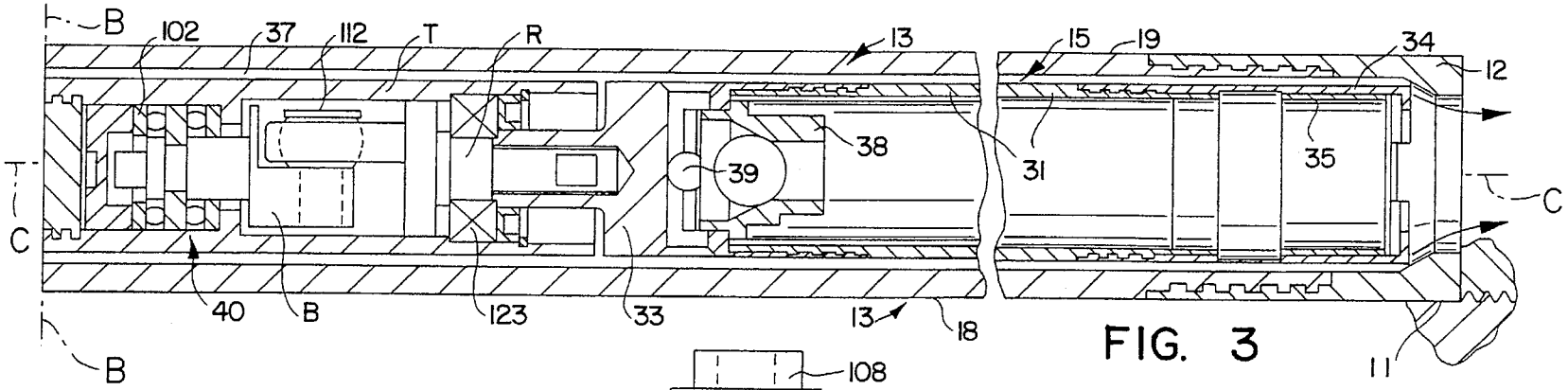
Figure 4:
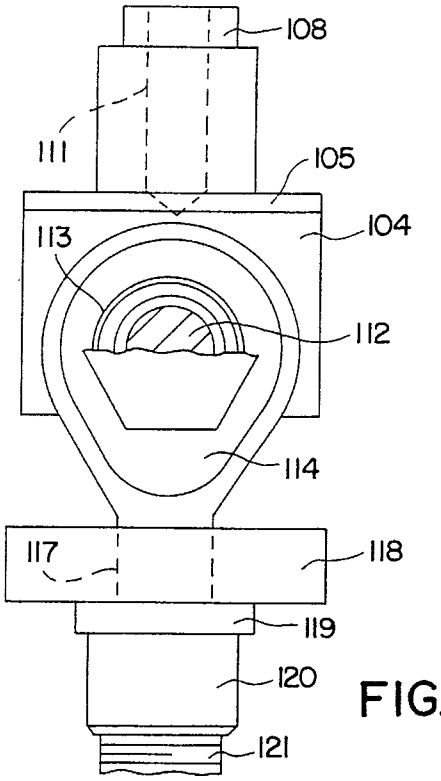
FIG. 4 is an enlarged, longitudinal section of the vibrational subassembly.

Referring now in particular to FIGS. 1–3, there is illustrated a hollow drill string 10 which is made up of a series of interconnected hollow drill rods (tubes). Even though illustrated as extending horizontally, the drill string 10 is in a downwardly extending bore hole 11 drilled in rock or other types of earth formations by means of an annular core bit 12. The pump apparatus indicated by block 84 pumps fluid under pressure through line 85 into the axial outer end of the drill string 10 in a conventional manner, the illustrated part of the drill string 10 in FIG. 1 being located just axially inwardly of the bit in the bore hole 11 and may be at a considerable depth below the formation surface.

The portion of the drill string attached to or extended below the pipe (rod) section **10*b* is commonly referred to as a core barrel outer tube assembly, generally designated 13, the core barrel outer tube assembly being provided for receiving and retaining the wire line core barrel inner tube assembly, generally designated 15. Details of the construction of the core barrel radial outer tube assembly of the general nature used in this invention may be such as that disclosed in U.S. Pat. Nos. 3,120,282 and 3,120,283. The outer tube assembly 13 includes an adaptor coupling 21 that is threadedly connected to the core barrel outer tube 18 to provide a recess in which a landing ring (drill string landing shoulder) 23 is mounted, a reaming shell 19 connected to the inner (lower) end of tube 18 and an annular drill (core) bit 12 at the inner (lower) end of the reaming shell for drilling into the earth formation from which the core sample is taken. The outer (upper) end of the assembly 13 includes a locking coupling 20 that connects the adaptor coupling to the adjacent pipe section 10*a* of the drill string. At the opposite end of the coupling 20 from the pipe section 10*a*, the locking coupling in conjunction with the annular recess of the coupling 21 form a latch seat 21*b* inside of the surface of the adaptor coupling against which the latches 47, 48 are seatable for removably retaining the core barrel inner tube assembly, generally designated 15, adjacent to the core bit. The inner end portion of the locking coupling has a conventional projection flange 20*b*** which extends as a partial cylindrical surface more closely adjacent to the core bit than to the main part of said coupling. This flange (or other structure) bears against a latch to cause the latches, the latch body and other portions of the inner tube assembly to rotate with the drill string when the latches are in a latched position, as is conventional.

The core barrel inner tube assembly 15 includes a latch body, generally designated 25, having a main body portion 44 with a conventional annular, axially inwardly facing shoulder 30 seatable on the landing ring 23 and a fluid bypass channel 28 to permit fluid flow to bypass the landing ring when the shoulder 30 is seated on the ring 23. That is, the portion of the inner tube assembly from the shoulder 30 and axially inwardly thereof is of a smaller diameter than at least the axial part of the main body outwardly of and adjacent to the shoulder while the channel has a port opening exterior of the latch body outwardly of the shoulder and a second port opening exterior of the latch body inwardly of the shoulder. Suitable valving (not shown) may be provided for blocking flow through the channel, for example of the type referred to in U.S. Pat. No. 3,103,981 to Harper or U.S. Pat. No. 4,800,969 to Thompson.

The assembly 15 also includes a core receiving tube 31, an inner tube cap 33 threaded into the outer (upper) end of the core receiving tube, a vibrational subassembly, generally designated 40, having an axial inner end threadedly connected to the tube cap and a spindle and bearing subassembly, generally designated 40, connecting the outer (upper) end of the vibrational subassembly to the inner (lower) end portion of the latch body. The core receiving tube has a replaceable core lifter case 34 and a core lifter 35, the structure and function of which may be generally the same as set forth in U.S. Pat. No. 2,829,868. A fluid passageway 39 formed in the cap 33 opens through a valve subassembly 38 to the interior of the outer end of the core receiving tube and at the opposite end to the annular clearance space 37 between the inner tube assembly 15 and the outer tube 18 that forms a part of the annular fluid channel 37 to, in conjunction with the bypass channels, permit fluid to bypass the inner tube assembly when in a core taking position such as illustrated in FIG. 1–3.

The core barrel inner tube assembly also includes a latch assembly L having a pair of latches 47, 48 with their lower end portions pivotally mounted in a latch body slot **25*b* by a pivot member 51 that is mounted by the latch body, and a spring 50 for constantly resiliently urging the latches to pivot to their latch seated positions. A latch retractor (release) tube 54 is mounted by the latch body for limited axial movement relative thereto for retracting the latch assembly from its latch seated position and alternately, for permitting the latch assembly moving to its latch seated position when the latches are adjacent to the latch seat, a pin 58 being mounted in an axial fixed position relative to retractor tube and extended through axially elongated slots 53 in the latch body to function in a conventional manner. A pin 55, which is mounted in a fixed position relative to the latch release tube, mounts the overshoot coupling member (spearpoint) 59** to the latch release tube for moving the latch release tube axially outwardly to retract the latches when the overshoot coupling member is moved axially outwardly by a conventional overshot assembly (not shown).

The core barrel spindle subassembly 41 includes an axially elongated spindle bolt 42 having an axial outer end threadedly connected to the inner end portion of the latch body with a lock nut 71 threaded on the bolt 42 to abut against the latch body. Inwardly of the lock nut an annular member 72 is mounted on the non-threaded part of bolt 42 in a fixed axial position relative to the bolt while axially intermediate an annular member 57 and member 72 there is mounted a shut off valve 73 to function in a manner similar to the valve members 47–49 of U.S. Pat. No. 3,333,647 to Karich. A spindle bearing 74 is mounted on the spindle bolt to abut against the member 57. Provided on the spindle bolt is a coil spring 78 that at one end abuts against a nut 87 threaded on the inner end of the spindle bolt while the opposite end of the spring abuts against a spacer 77 to resiliently urge the spacer to remain in abutting relationship to the axially inwardly facing shoulder **42*b* formed by the inner end and intermediate diameter portions of the spindle bolt while permitting the spindle bolt being moved axially outwardly a limited amount relative to the spacer while compressing the spring 78**.

An axially elongated spring housing 75 has an axially elongated, outwardly opening bore 81 with the inner end of the spindle bolt together with the coil spring and spacer located therein. The adjacent end portions of the spindle bearing and spring housing are threadedly connected. A cut out is provided on the spindle bolt to form an axially elongated flat 79 that extends axially from the spacer 77 and outwardly to a location adjacent the annular member 72 while a key 80 is mounted by the spindle bearing to extend in abutting relationship to the flat to prevent the spindle bearing and thereby the spring housing from rotating relative to the spindle bolt while permitting axial movement of the spindle bearing relative to the spindle bolt. Annular members 74, 57 are axially movable relative to the spindle bolt to permit the annular member 57 being moved axially to compress the shut off valve between members 57, 72 to a radial expanded condition for blocking fluid bypass flow in the annular space 37, i.e. to prevent fluid bypass in the outer tube 18.

Figure 5:
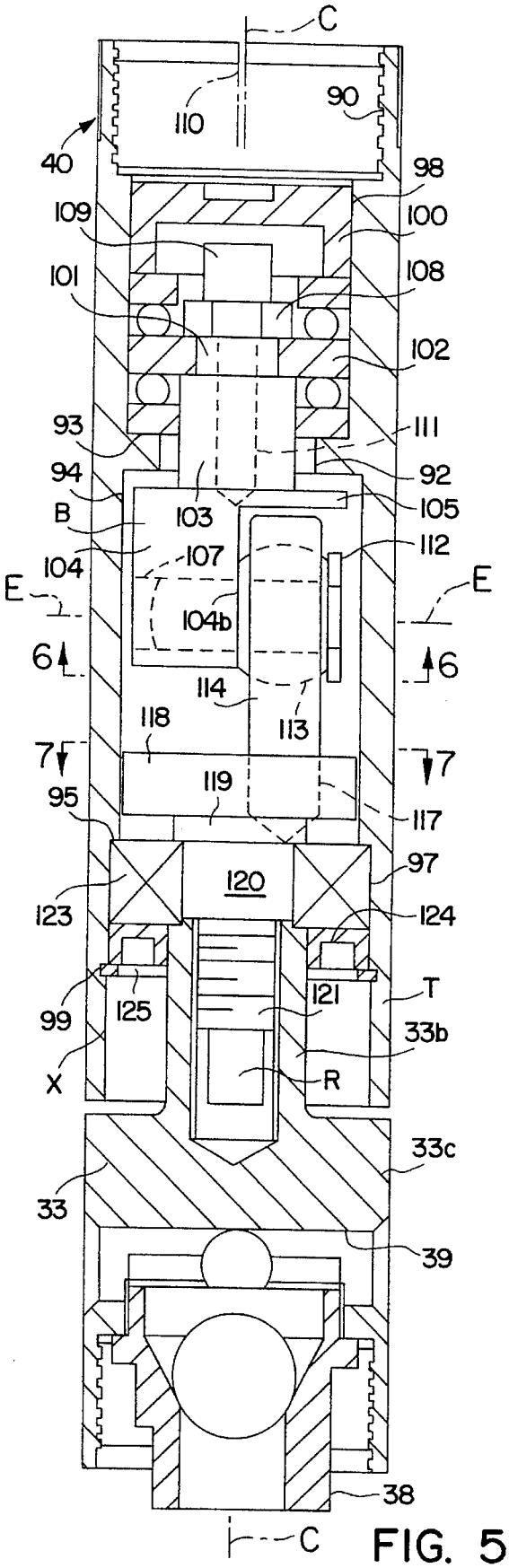
FIG. 5 is fragmentary view of part of the vibrational subassembly that is taken at generally right angles to that shown in FIG. 4 with part of the cap screw being broken away.
Figure 6:
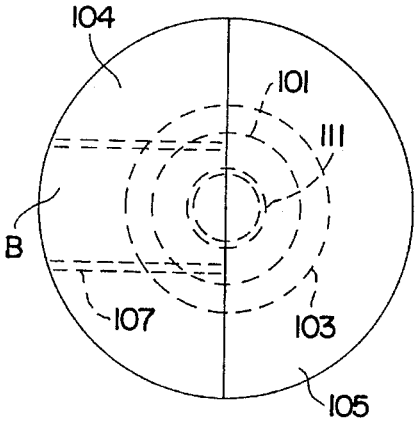
FIG. 6 is a transverse cross sectional view generally taken along the line and in the direction of the arrows 6—6 of FIG. 5.
Figure 7:
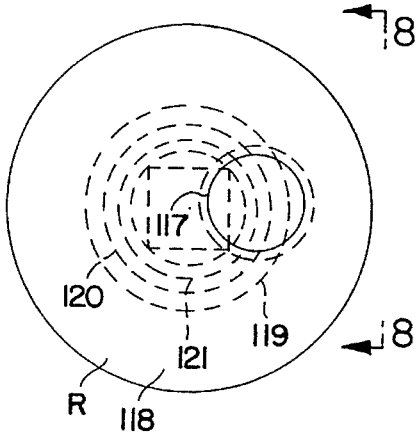
FIG. 7 is a transverse cross sectional view generally taken along the line and in the direction of the arrows 7—7 of FIG. 5.
Figure 8:
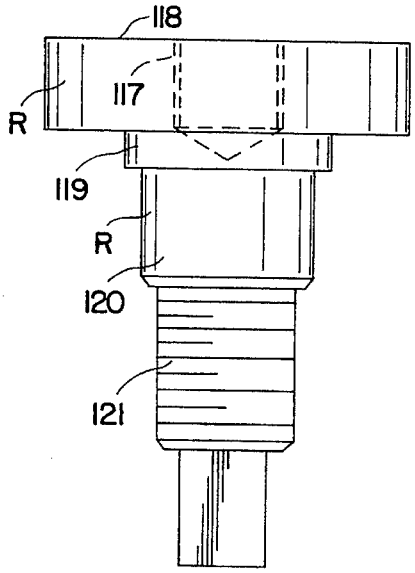
FIG. 8 is a transverse cross sectional view generally taken along the line and in the direction of the arrows 8—8 of FIG. 7.

The outer end of the vibrational assembly 40 is threadedly connected to inner threaded end of the spring housing 75. Referring to FIG. 5, the vibrational assembly includes an axially elongated bearing tube T having a bore X extending axially therethrough, the bore including an axially outer bore portion 90 threadedly connected to the spring housing. The bore X also includes a reduced diameter bore portion 98 that has an axially outer threaded end part that opens to bore portion 90 and an opposite end part that opens to reduced diameter bore portion 92 to form an axially outwardly facing shoulder 93. Opposite shoulder 93, the bore includes a larger diameter bore portion 94 while the inner end of portion 94 opens to a further enlarged diameter portion 97 to form an axially inwardly facing shoulder 95. Bore portion 97 is of a constant diameter other than for an axial intermediate, annular recess 99 which is of a larger diameter.

The central axes of all of the bore portions of bore X, other than for bore portions 98, coincides with the central axis C—C of the core barrel inner tube assembly while the central axes of bore portion 98 is inclined relative to central axis C—C as indicated by line 110 by an angle of for example one degree while the planes of the annular shoulder 93 is at right angles to axis 110.

A cylindrical roller bearing 102 is mounted in the inner part of bore portion 98 and is retained in abutting relationship to shoulder 93 by a cap nut 100 that is threaded in the outer part of bore portion 98. A bearing spindle B has a semi-cylindrical portion 104 and a semicircular disk portion 105 that is of a much smaller axial dimension than portion 104. Portions 104, 105 are located in bore portion 94 and radially spaced from the internal wall defining said bore portion. The combination of portions 104, 105 are circular when looking axially inwardly and are of a diameter to leave an annular clearance space between them and the radial inner peripheral wall defining bore portion 94. The spindle subassembly also includes a cylinder portion 103 integrally formed with portions 104, 105 to extend axially outwardly through bore portion 92 and into the cylindrical roller bearing 102 while a reduced diametric cylindrical portion 101 is joined to and extends outwardly of portion 103. An annular retainer 108 has a diametric portion abutting against the axial outer, transverse surface of the intermediate race of bearing 102 to, in combination with the cap bolt 109 extended through retainer 108 and threaded into the vertical threaded bore 111 in the cylindrical portion 101, 103, to retain the axial outer transverse surface of the bearing spindle in abutting relationship to the axial inner transverse surface of the intermediate race of the thrust bearing while permitting relative rotation between the bearing spindle and the bearing tube.

The generally planar chordal face **104*b* of cylindrical portion 104 contains a straight line extension of the central axis of the bore portion 98 while the threaded aperture 107 in the cylindrical portion extends perpendicularly to the chordal face. A pivot member (cap screw) 112 is threaded into the transverse bore 107 in the semi-cylindrical portion 104 to have a pivot axis E—E that extends at right angles to axis 110 to intersect the central axis C—C at the intersection of axis 110 with axis C—C. The pivot member 112 mounts a spherical bearing member 113 that is pivotal in the partial spherical recess in the eye rod 114 to permit spherical pivotal movement of the eye rod relative to the bearing spindle, the spherical bearing being pivotable in the eye rod. The eye bolt is threaded into an aperture 117 in the enlarged diametric portion 118 of the cap shaft R, the shaft having a reduced diameter portion 121 threaded into the axial outer reduced diameter portion 33*b* of the cap 33** which extends into and axially inwardly of the bearing tube.

The cap shaft includes a first intermediate diameter portion 119 extending inwardly of portion 118 to form an axially inwardly facing shoulder for abutting against the axial outer annular surface of the inner race (not shown) of a conventional bearing 123 which permits axial slidable movement of the bearing tube and thus, for convenience, will be referred to as a "slide bearing" while the axial opposite surface of the slide bearing abuts against the axial outer transverse surface of the cap reduced diameter portion **33*b*. The axial outer annular surface of the outer race (not shown) of the bearing 123 is in abutting relationship to the bearing tube shoulder 95. The slide bearing 123 retains the cap radially centered relative to the bearing tube such that the cap central axis is coextensive with the central axes of the bearing tube and the core receiving tube. An annular fluid seal 124 extends radially between the inner peripheral wall defining bore portion 97 and the outer peripheral surface of the cap reduced diameter portion, and axially between the bearing 123 and the radially slit retainer ring 125 that is mounted in the recess 99**.

The cap reduced diameter portion is integrally joined to the cap main body portion **33*c* which advantageously is of the same outer diameter as the outer diameter of the bearing tube. Further, cap 33 is movable a limited axial amount relative to the bearing tube. The cap shaft is mounted by the slide bearing 123** for limited axial movement relative to the bearing tube, while the cap shaft is in a fixed axial and angular position relative to the cap.

In view of the threaded connection between the spindle bolt and the latch body, the threaded connections between the spindle bearing, the spring housing and the spring housing and the bearing tube, and the flat on the spindle bolt and the key mounted by the spindle bearing, these members are retained in fixed angular relationship to one another and their central axes, other than for the key, are coextensive with one another and with the central axis of the inner tube assembly, including with the core receiving tube and the core bit when said assembly is in its latch seated position in the drill string.

In using the apparatus of this invention, for example, the core barrel inner tube assembly 15, the assembly 15 is inserted into the outer end of the drill string and is lowered by a wire line overshot assembly, or allowed to free fall through the drill string until the latch body shoulder seats on the landing ring. Now as conventional, the latches seat in the latch seat and upon rotating the drill string, the flanges **20*b* abuts against the latches to cause the latches, the latch body, the spindle subassembly 41** and the bearing tube to rotate therewith. Likewise, as the drill string is rotated, an axial inward force is transmitted through the latches, the latch body, the spindle subassembly and the bearing tube which results in the core receiving tube moving axially inwardly to have core extending thereinto. Usually, the core in the core receiving tube prevents the core receiving tube from rotating as the drill string is rotated, the vibrational subassembly permitting the core receiving tube remaining stationary while the spindle subassembly rotates.

As the bearing tube is rotated, the core receiving tube, core lifter case and core lifter are moved a limited amount axially inwardly and outwardly relative to the bearing tube. This movement results due to the plane of the annular surface of the shoulder 93 of the bearing tube being inclined relative to the central axis of the inner tube assembly, and accordingly the central axis 110 of the bearing 102 and the cylindrical portions of the bearing spindle are similar inclined. Desirably the axis 110 intersects the inner tube assembly central axis C—C at the intersection of the spherical bearing axis E—E with the central axis C—C. Since, as the bearing tube rotates, the eye rod 114 mounts the spherical bearing to pivot relative thereto and be axially move and the bearing spindle does not rotate with the bearing tube, the bearing spindle is moved such that axis 110 traces a substantially conical path around axis C—C with the cone apex being adjacent to the intersection of axes 110, C—C and E—E, and pivot member 112 and thereby axis E—E is moved about the intersection mentioned in the preceding sentence. Thus, as the bearing tube rotates relative to the bearing spindle, the central axis of the bearing spindle central portion is angularly varied relative to the bearing tube and inner tube assembly axis C—C as a generatrix of a cone. This movement of the pivot member 112 results in the spherical bearing moving relative to the eye bolt and axially moving the eye rod. Thus the spherical bearing pivots in the eye rod so that the eye rod is only moved axially (axially reciprocate) as long as the core receiving tube is not rotated as the latch body is rotating about the central axis C—C. It is noted that the center of curvature of the spherical surface of bearing 113 is transversely offset from the inner tube assembly central axis C—C, the semi-cylindrical portion 104 and the above mentioned intersections of axes.

The axial movement of the eye bolt correspondingly moves the cap shaft and thereby the cap 33 and core receiving tube. The slide bearing permits such axial movement, the bearing tube rotating relative to the slide bearing and retaining the cap shaft centered relative to the bearing tube. As a result of providing the bearing 102 with its axis offset from the central axis C—C and the bearing spindle, for each 360° cycle of revolution of the bearing tube, the core receiving tube is axially reciprocated (axially vibrates) through one cycle. As an example, the axis 110 may be inclined at an angle of about one degree relative to the central axis C—C and the core receiving tube is first moved about 0.25 mm axially toward the bearing tube and then 0.25 mm axially away from the bearing tube.

As a result of axially reciprocating the core receiving tube when collecting core, particularly in broken earth formations and sandy gravel formation, the entire core receiving tube can be filled. This is in contrast to only rotating and moving the core receiving tube axially inwardly in such formation as the core receiving tube is moved axially over the core wherein usually there is a tendency to have the radial outer part of the tube packed while the radial central part of the tube would not be filled. Further, as a result of the core receiving tube being axially reciprocated, the core receiving tube more easily moves over the core without substantially increasing the amount of fracturing of the core being collected. Upon the core receiving tube being filled, the core barrel inner tube assembly can be retracted in a conventional manner. Upon the filling of the core receiving tube, the continued downward force on the latch body results in the drill string moving downwardly relative to the core receiving tube and the spindle bolt moving downwardly relative to the spindle bearing such that the shut valve is operated to its fluid flow blocking condition to provide a high pressure signal at the drilling surface. The spindle subassembly in being connected through the vibrational subassembly to the cap shaft, blocks spindle housing and thereby the spindle bearing being moving downwardly with the spindle bolt.

Even though the invention has been described with reference to a core barrel inner tube assembly that is used for drilling in a downward direction, it is to be understood the vibrational subassembly may be used with inner tube assemblies that are fluidly propellable to the bit end of the drill string, including in bore holes that extend vertically upwardly from the drilling surface as long as the latch body is rotated with the drill string and can rotate relative to the core receiving tube. Further, the mechanism for latching the latch body to the drill string and/or the spindle subassembly may be varied as long as the bearing tube is rotated with the drill string as core is being drilled and can be rotated relative to the core receiving tube.

It is to be understood that the combination of the spindle assembly and the vibrational subassembly of this invention together with an appropriate length core receiving tube and core cap may be sold as a conversion kit to replace a conventional spindle assembly, the core cap and core receiving tube, for example such as described in U.S. Pat. Nos. 3,340,939 or 3,346,059 or 5,267,620 or 5,325,930.

What is claimed is:

1. A wire line drilling apparatus having an axial extending central axis and being movable axially inwardly through a rotatable drill string toward a bit end of the drill string having a core bit thereat to a position adjacent to the bit end of the drill string to latchingly engage a drill string latch seat and is retractable axially outwardly through the drill string in a direction away from the bit end of the drill string, said drill string having a central axis, comprising an axially extending latch body having a central axis, an outer end portion and an inner end portion, a latch mounted to the latch body for movement between a latch seated position for releasably retaining the latch body in the drill string adjacent to the core bit and cooperate with the drill string when the drill string is rotated to rotate the latch body, and a latch release position permitting the latch body being retracted through the drill string, an axially extending latch retractor mounted to the latch body for limited axial movement relative to the latch body to retract the latch from its latch seated position, said latch retractor having an outer overshot coupling portion, axially elongated tubular means for receiving a core therein, said tubular means having an open axial inner end and an axial outer end, and mechanical vibrational means for imparting axial reciprocal movement to the tubular means as the tubular means receives a core and the latch body is rotated while permitting the latch body rotating relative to the tubular means, the vibrational means having an axial outer end connected to the latch body inner end and an axial inner end connected to the tubular means axial outer end, the vibrational means including a bearing spindle having a cylindrical portion, said cylindrical portion having a central axis, a bearing tube having a central axis that is coaxial with the latch body central axis, means for mounting the bearing tube to the latch body to extend axially inwardly of the latch body and to rotate the bearing tube as the latch body is rotated, bearing means mounted by the bearing tube for mounting said cylindrical portion to have the cylindrical portion central axis inclined at an acute angle relative to the bearing tube central axis and permitting the bearing tube to rotate relative to the cylindrical portion and to move the cylindrical portion and thereby the bearing spindle to vary the angular position of the cylindrical portion central axis relative to the bearing tube central axis, and means connecting the bearing spindle to the tubular means to reciprocate the core receiving means as the bearing spindle is moved.

2. A wire line core barrel apparatus of claim 1 wherein the means for mounting the bearing tube to the latch body includes an axially elongated spindle member mounted to the latch body in fixed angular relationship and spindle bearing means mounted to the spindle member for limited axial movement relative to the spindle member in a fixed angular relationship to the spindle member, said spindle bearing means being connected to the bearing tube in fixed angular relationship relative thereto.

3. A wire line core barrel apparatus of claim 2 wherein there is provided shut off valving mechanism on the spindle member that is operable to a fluid blocking condition and the spindle bearing means includes means axially movable with the bearing tube and relative to the spindle member toward the latch body to operate the valving mechanism to its fluid blocking condition.

4. A wire line core barrel apparatus of claim 1 wherein the means for connecting the bearing spindle to the tubular means includes a core receiving tube cap, a cap shaft connected to the cap for axially moving the cap, said cap shaft having a central axis, bearing means mounted by the bearing tube axially inwardly of the bearing spindle for mounting the cap shaft for limited axial movement while retaining the cap shaft in a fixed radial relationship to the bearing tube and thereby the cap shaft central axis coaxially relative to the latch body central axis and means for connecting the cap shaft to the bearing spindle for axially moving the cap shaft as the bearing spindle is moved relative to the bearing tube.

5. A wire line core barrel apparatus of claim 4 wherein the means for connecting the cap shaft includes an axially extending connector member joined to the cap shaft in radial offset relationship to the cap shaft central axis to extend axially outwardly thereof, a spherical bearing member mounted by the connector member for spherical pivotal movement relative to the connector member and means having a transverse pivot axis extending at substantially right angles to the bearing spindle cylindrical portion axis and being mounted to the bearing spindle for moving the spherical bearing relative to the bearing tube to reciprocate the cap shaft as the bearing tube rotates relative to the spindle bearing, the means having a transverse axis mounting the spherical bearing member in the same angular relationship relative to the bearing tube central axis as the connector member is offset relative to the cap shaft.

6. For collecting a core sample drilled by a core bit, core drilling apparatus comprising an axially elongated, radial outer core barrel having an axial outer and an axial inner end adapted for mounting a core bit, axially elongated tubular means within the outer barrel for collecting a core sample, a spindle subassembly having an axial outer end and an axial inner end, first spindle subassembly connecting means for connecting the spindle subassembly outer end to the outer barrel for rotating the spindle subassembly as the outer barrel is rotated, and second spindle subassembly connecting means for connecting the spindle subassembly to the tubular means for rotation relative to the tubular means to axially reciprocate the tubular means within the outer barrel and relative to the spindle subassembly as the spindle subassembly is rotated while permitting the spindle subassembly to rotate relative to the tubular means, the second spindle subassembly connecting means including means to first move the tubular means in one axial direction relative to the spindle assembly and then move the tubular means in the opposite axial direction relative to the spindle assembly for each revolution of the outer barrel relative to the tubular means.

7. For connecting a latch body to a core receiving tube cap and axially moving the core receiving cap as the latch body is rotated, the combination of an axially elongated, rotatable spindle member having an axial outer end adapted for being joined to the latch body in fixed angular relationship thereto and an axial inner end, spindle bearing mechanism mounted to the spindle member for limited axial movement relative thereto and in fixed angular relationship thereto, said spindle member having a central axis, a cap shaft adapted for being attached to the core receiving cap in a fixed axial and angular relationship, and mechanical vibrational means connected between the cap shaft and the spindle bearing mechanism for axially vibrating the cap shaft while the spindle bearing mechanism is rotated relative to the cap shaft and permitting the spindle bearing mechanism rotating relative to the cap shaft, the vibrational mechanism including a slide bearing for mounting the cap shaft for limited axial movement relative thereto, axially elongated tubular means for mounting the slide bearing therein to retain the cap shaft in fixed radial relationship thereto, said tubular means having a central axis coextensive with the spindle member central axis and an axial outer end mounted to the spindle bearing mechanism to retain the tubular means in fixed angular relationship to the spindle member to rotate as the spindle member is rotated, a bearing spindle mounted within the tubular means and having a central axis, bleating mechanism mounted in the tubular means for mounting the bearing spindle to have the bearing spindle axis intersect with the tubular means axis at an acute angle and angularly move the bearing spindle to revolve the bearing spindle axis around the tubular means central axis at a substantial fixed acute angle relative thereto and permitting rotation of the tubular means relative to the bearing spindle, and means for vibrating the cap shaft as the bearing spindle is moved.

8. The apparatus of claim 7 wherein the means for vibrating the cap shaft comprising a spherical bearing, means for moving the cap shaft as the spherical bearing is moved, the means for moving the cap shaft mounting the spherical member for pivotal movement relative thereto and means mounted to the bearing spindle to move therewith for axially moving the spherical bearing while the tubular means rotates relative to the bearing spindle.

9. Wire line core barrel inner tube assembly for taking a core sample, comprising an axially elongated, rotatable latch body, said latch body having a central axis and an axial inner end portion, an axially elongated spindle member having an axial outer end mounted to the latch body inner end portion in fixed angular relationship thereto to rotate as the latch body is rotated, core receiving tubular means having an axial outer end portion for collecting a core sample and mechanical vibrational means for vibrating the tubular means in opposing axial directions as the spindle member is rotated relative to the tubular means, the vibrational means connecting the latch body to the tubular means for relative rotation, the latch body, spindle member and tubular means having coextensive central axes, the vibrational means including a spindle bearing mounted to the spindle member for limited axial movement relative thereto between an axial inner position relative to the spindle member and an axial outer position relative to the spindle member, cooperating means on the spindle bearing and the spindle member for retaining them in fixed angular relationship to rotate the spindle bearing as the spindle member is rotated while permitting the spindle bearing to move axially relative to the spindle member, compressible shut off valving mechanism mounted on the spindle member for being compressed to a fluid flow blocking position by the spindle bearing moving toward the axial outer position, and means operated by the rotation of the bearing spindle for reciprocating the tubular means as the latch body is rotated relative to the tubular means.

10. For use with apparatus for drilling a core sample to collect a core sample, an axially elongated, rotatable core barrel spindle subassembly having a central axis and an axial inner end portion, an axially core receiving tube having a central axis, an axial outer end and an inner end, bearing mechanism having a central axis, a slide bearing having a central axis, axially elongated annular means that has a central axis coextensive with the spindle subassembly axis for mounting the bearing mechanism axially outwardly of the slide bearing with the bearing mechanism central axis extending axially outwardly and radially outwardly relative to the annular member central axis at an acute angle and mounting the slide bearing to have the slide bearing axis coaxial with the spindle subassembly axis, the annular means being mounted to the spindle subassembly for rotation with the spindle subassembly and relative to the core receiving tube and means mounted by the bearing mechanism for movement relative thereto as the annular means is rotated relative to the core receiving tube to axially reciprocate the core receiving tube and permit the annular means rotating relative to the core receiving tube.

11. For collecting a core sample drilled by a core bit, core drilling apparatus comprising an axially elongated, radial outer core barrel having an axial outer and an axial inner end adapted for mounting a core bit, axially elongated tubular means within the outer barrel for collecting a core sample, a spindle subassembly having an axial outer end and an axial inner end, first spindle subassembly connecting means for connecting the spindle subassembly outer end to the outer barrel for rotating the spindle subassembly as the outer barrel is rotated, and second spindle subassembly connecting means for connecting the spindle subassembly to the tubular means for rotation relative to the tubular means to axially reciprocate the tubular means within the outer barrel and relative to the spindle subassembly as the spindle subassembly is rotated while permitting the spindle subassembly to rotate relative to the tubular means, the spindle subassembly and tubular means having coextensive central axes, the second spindle subassembly connecting means including a spherical bearing having a generatrix point of curvature radially offset from said central axes, bearing mechanism mounted by the spindle subassembly for axially moving the spherical bearing axially inwardly and then axially outwardly for each revolution of the outer barrel relative to the tubular means, the bearing mechanism having a central axial axis, and axial moving means mounted to and extending between the spherical bearing and the tubular means to axially move the tubular means relative to the outer barrel as the spherical bearing is moving axially.

12. For collecting a core sample drilled by a core bit, core drilling apparatus comprising an axially elongated, radial outer core barrel having an axial outer and an axial inner end adapted for mounting a core bit, axially elongated tubular means within the outer barrel for collecting a core sample, a spindle subassembly having an axial outer end and an axial inner end, first spindle subassembly connecting means for connecting the spindle subassembly outer end to the outer barrel for rotating the spindle subassembly as the outer barrel is rotated, and second spindle subassembly connecting means for connecting the spindle subassembly to the tubular means for rotation relative to the tubular means to axially reciprocate the tubular means within the outer barrel and relative to the spindle subassembly as the spindle subassembly is rotated while permitting the spindle subassembly to rotate relative to the tubular means, the spindle subassembly having a central axis, the second spindle subassembly connecting means including a radial bearing mechanism having a central axis, axially elongated annular means that has a central axis coextensive with the spindle subassembly central axis for mounting the bearing mechanism axially outwardly of the slide bearing with the bearing mechanism central axis extending axially and radially outwardly relative to the annular member central axis at an acute angle and the slide bearing with the slide bearing axis coextensive with the spindle subassembly central axis, the annular means being mounted to the spindle subassembly for rotation with the spindle member and relative to the tubular means, a spherical bearing, and operable means mounted by the bearing mechanism for movement therewith and relative thereto to move the spherical bearing axially as the annular member is rotated relative to the tubular means, and axial moving means to axially move the tubular means relative to the outer barrel as the spherical bearing is moving axially.

13. A wire line core barrel apparatus of claim 12 wherein said angle is about one degree and the tubular means is reciprocated axially about 0.25 mm.

14. A wire line core barrel apparatus of claim 12 wherein the axial moving means includes a slide bearing having a central axis coextensive with the spindle subassembly central axis, a connecting shaft mounted by the slide bearing for axial movement, said connecting shaft being joined to the tubular means to move the tubular means therewith, and a connecting rod for moving the connecting shaft therewith, said connecting rod mounting the spherical bearing for spherical pivotal movement relative thereto and axial movement therewith and being connected to the connecting shaft.

15. Wire line core barrel inner tube assembly for taking a core sample, comprising an axially elongated, rotatable latch body, said latch body having a central axis and an axial inner end portion, an axially elongated spindle member having an axial outer end mounted to the latch body inner end portion in fixed angular relationship thereto to rotate as the latch body is rotated, core receiving tubular means having an axial outer end portion for collecting a core sample and mechanical vibrational means for vibrating the tubular means in opposing axial directions as the spindle member is rotated relative to the tubular means, the vibrational means connecting the latch body to the tubular means for relative rotation, the latch body, spindle member and tubular means having coextensive central axes, the vibrational means including a bearing spindle having a cylindrical portion that has a central axis, mounting means for mounting the bearing spindle to have the cylindrical portion central axis inclined axially outwardly and radially outwardly relative to the coextensive axes at an acute angle and to move the cylindrical portion for moving the central portion central axis to revolve around the coextensive axes as the spindle member is rotated, said mounting means being connected to the spindle member in fixed angular relationship thereto, and operable connector means for axially reciprocating the tubular means relative to the mounting means as the spindle member is rotated and the bearing spindle is moved, said connector means being mounted to the bearing spindle for movement therewith and relative thereto and being joined to the tubular means.

16. A wire line core barrel inner tube assembly of claim 15 wherein the mounting means includes a first bearing mounting the bearing spindle cylindrical portion, said first bearing having a central axis coextensive with the cylindrical portion central axis, second tubular means connected to the spindle member in fixed angle relationship for mounting the first bearing and moving the first bearing to move the first bearing axis relative to the coextensive axes as the spindle member is rotated, and the connector means includes a slide bearing having a central axis and being mounted by the second tubular means to have its central axis coextensive with the axes of the spindle member and the first tubular means and means in axial slidable relationship to the slide bearing for connecting the bearing spindle to the first tubular means.

17. A wire line core barrel inner tube assembly of claim 15 wherein the connector means includes a spherical bearing, an eye member mounted to the spherical bearing in pivotal relationship thereto and for movement therewith and means connected to the first tubular means for axially moving the tubular means as the spherical bearing is moved.

18. For collecting a core sample drilled by a core bit, core drilling apparatus comprising an axially elongated, radial outer, rotatable core barrel having an axial outer and an axial inner end adapted for mounting a core bit, axially elongated tubular means within the outer barrel for collecting a core sample, said tubular means having a central axis, an axial outer end and an inner end, a latch body assembly removably retained in the outer barrel to rotate with said outer barrel, and mechanical connecting means for connecting the latch body inner end portion to the tubular means axial outer end to move the tubular means in one axial direction relative to the latch body and then move the tubular means relative to the latch body in the opposite axial direction for each revolution of the outer barrel relative to the tubular means, said mechanical connecting means having an axial outer end portion connected to the latch body inner end portion and an axial inner end portion mounted to the tubular means in fixed angular relationship to the tubular means.

* * * * *